United States Patent [19]

Fröseth

[11] Patent Number: 4,738,067

[45] Date of Patent: Apr. 19, 1988

[54] ROOF PANEL

[76] Inventor: Per Fröseth, Holtevegen 7, N-1400 Ski, Norway

[21] Appl. No.: 789,966

[22] PCT Filed: Feb. 5, 1985

[86] PCT No.: PCT/SE85/00051

§ 371 Date: Oct. 9, 1985

§ 102(e) Date: Oct. 9, 1985

[87] PCT Pub. No.: WO85/03540

PCT Pub. Date: Aug. 15, 1985

[30] Foreign Application Priority Data

Feb. 10, 1984 [SE] Sweden ..... 8400701

[51] Int. Cl.[4] ..... E04C 2/50; E04D 1/28; E04D 3/35

[52] U.S. Cl. ..... 52/478; 52/408; 52/506; 52/510; 52/520; 52/536; 52/580; 52/588; 52/785; 52/813; 52/748

[58] Field of Search ..... 52/408, 409, 488, 588, 52/553, 576, 583, 483, 404, 90, 579, 406, 536, 537, 538, 531, 822, 589, 592, 601, 813, 821

[56] References Cited

U.S. PATENT DOCUMENTS

| | | | |
|---|---|---|---|
| 2,115,936 | 5/1938 | Sterns | 52/601 |
| 3,886,705 | 6/1975 | Cornland | 52/588 X |
| 4,130,975 | 12/1978 | Kelley | 52/588 |
| 4,423,581 | 1/1984 | Miller | 52/531 X |
| 4,433,514 | 2/1984 | Herges, Jr. et al. | 52/588 X |
| 4,441,291 | 4/1984 | Sokoler et al. | 52/588 X |

FOREIGN PATENT DOCUMENTS

| | | | |
|---|---|---|---|
| 334996 | 4/1971 | Sweden | 52/588 |
| 7707121 | 6/1979 | Sweden | 52/553 |
| 8007804 | 9/1983 | Sweden | 52/553 |
| 8002947 | 10/1983 | Sweden | 52/553 |

*Primary Examiner*—Alfred C. Perham

*Attorney, Agent, or Firm*—Roberts, Spiecens & Cohen

[57] ABSTRACT

A roof panel (1), which includes a support course (12) for supporting a water-impervious layer (11) or for supporting a windproof layer. The roof panel additionally includes a lower diffusionproof layer (15) and normally one insulating course (14) located in the region between the lower diffusionproof layer and the support course. The roof panel is disposed with a frame (16) which forms the outer edges (20–23) of the roof panel, in addition to which the frame along opposite edges is disposed with devices in order to affix adjacent roof panels in relation to one another and in order to affix the roof panels to a substrate (4) such as a roof truss, a support wall etc.

13 Claims, 4 Drawing Sheets

ROOF PANEL

FIELD OF THE INVENTION

The present invention relates to a roof panel, which includes a support course for the supporting of a water-impervious layer or of a windproof layer, a lower diffusionproof layer and at least one insulating course located in the region between the lower diffusionproof layer and the course for the supporting of the water-impervious layer, and more specifically, the invention relates to a roof panel disposed with a frame, which forms the outer edges of roof panel, in addition to which the frame along opposite edges is including devices in order to affix to one another roof panels located adjacent to one another.

BACKGROUND

The constantly rising costs of material and labour in conjunction with building operations have led to an ever-increasing use of prefabricated units on building sites. Consequently an overwhelming proportion of the manual labor can be performed indoors, while the extent of the labor on the building site can be reduced. This leads to a rise in the quality of the completed building, since the bulk of the work takes place in an environment that is controlled with respect to wind and weather. These improvements in quality are especially noticeable in the use of constructional units that contain all walls or roof sections counted from the inside of the completed building to its outside. The present invention relates to a roof panel, which at least in certain embodiments is supplied to the building site in a completely finished condition, i.e. with both outer water-repellent roof cladding and completed inner roof cladding.

SUMMARY OF THE INVENTION

In accordance with the invention the roof panel consists of a frame, which is preferably formed of joined steel or aluminum beams. The frame forms the outer edges of the roof panel. The roof panel includes a course for supporting a water-impervious layer which comprises the outer roof cladding. Hereinafter, the term "support course is used for this aforementioned course. In certain embodiments, the support course" comprises a substrate for a windproof layer above which is disposed a separate water-impervious layer which may be a corrugated sheet. In the vicinity of the under side of the roof panel there is disposed a lower diffusionproof layer, in addition to which an insulating course is located in the region between the lower diffusionproof layer and the support course. Along one of its edges the roof panel is disposed with a section facing outwards from the edge and located predominantly below the limitation surface, which section forms an upwards-facing recess. The opposite edge of the roof panel is disposed with a device located below the lower limitation surface, the outer dimensions of said device being adapted to the inner dimensions of the recess so that with the panels placed edge to edge, the device of one roof panel fits into the recess of the other roof panel whereby the roof panels are locked in relation to one another.

In a preferred embodiment, the remaining two edges of the frame are constructed at in their upper edge regions for interaction with one another. Thus one of the edges has in its upper region an outwards-facing flange, while the other edge has in its upper region an inwards-facing flange, whereby the positions of the outwards-facing flange and the inwards-facing flange are so selected that with two roof panels placed edge to edge, the outwards-facing flange is located above the inwards-facing flange in order to allow the affixing of both flanges to one another.

In a further preferred embodiment, one of the edges stated in the preceding paragraph is disposed with an outwards-facing flange in the lower region of the edge, whereby the lower limitation surface of the outwards-facing flange is preferably located somewhat below the lower limitation surface of the roof panel. The outwards-facing flange thereby comprises a support device for abutment of the roof panel against a substrate, e.g. a roof beam, and additionally comprises a device for affixing the roof panel to the substrate.

In another embodiment, the lower diffusionproof layer in the vicinity of the edges of the frame is drawn upwards towards the upper limitation surface of the roof panel and preferably reaches up to the region for said surface.

In a further embodiment, the frame is disposed with transverse auxiliary beams, which run between two opposite edges of the frame. The auxiliary beams stabilize the frame and additionally may comprise support devices for disc-shaped panels which form a lower limitation layer of the roof panel, e.g. form the inner cladding of the completed roof.

In a further preferred embodiment, the roof panel in the region between the upper water-impervious layer and the upper limitation of the frame is disposed with an insulating course. This reduces the risk of thermal bridges, e.g. formed by the frame of the roof panel.

In another preferred embodiment, the windproof layer, the upper insulating course and/or the support course form protruding portions along two adjacent edges. Said layers or courses are in the case of the remaining two edges recessed in order to form regions in which the roof panel is exposed so that in two adjacently located roof panels the protruding portions cover the adjacently located exposed edge regions of two roof panels.

The upper insulating course comprises in yet another embodiment of the invention the support course for the water-impervious layer.

BRIEF DESCRIPTION OF THE DRAWING

The invention is described in greater detail with reference to a number of figures in the attached drawing wherein.

DETAILED DESCRIPTION OF PREFERRED EMBODIMENT

Figure 1A:
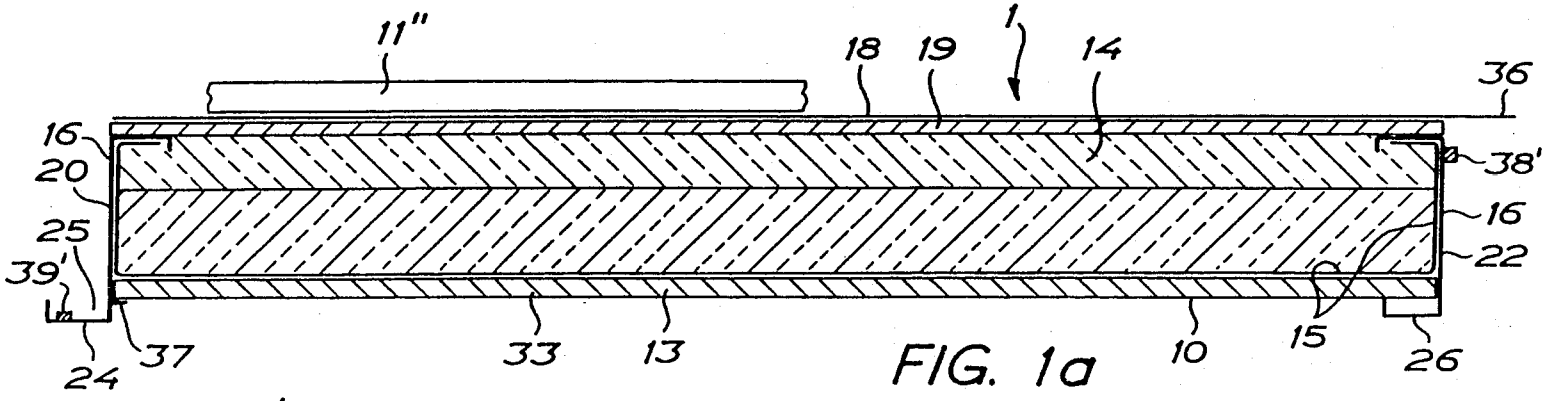
FIGS. 1*a,b* illustrate a cross-section and a longitudinal section, respectively, through a roof panel in accordance with one embodiment of the invention.

In the figures of drawing are seen embodiments of a roof panel 1, which includes a frame 16, preferably composed of steel or aluminum beams, whereby the frame forms outer edges 20–23 of the roof panel. Along the first edge 20, the frame includes a section 24 facing outwards from the edge, which section forms an upwards-facing recess 25. This outwards-facing section is predominantly located below the lower limitation surface 10 of the roof panel. The opposite edge 22 of the frame includes a device 26, located behind the edge, which forms a downwards-facing protuberance. The device 26 has an outer shape and outer dimensions adapted to the inner shape and dimensions of the recess 25 so that the device 26 fits into the recess 25.

The remaining two edges 21,23 of the frame are also constructed for interaction with one another. The edge 21 has at its upper edge region an outwards-facing flange 27, and the opposite edge 23 is provided at its upper edge region with an inwards-facing flange 29. The positions and dimensions of the outwards-facing flange 27 and the inwards-facing flange 29 are so selected that with the panels placed next to one another the outwards-facing flange 27 is located above the inwards-facing flange 29. The flanges are as a rule dimensioned such that in the case of installed units the uppermost outwards-facing flange 27 leaves a strip-like region exposed on the underlying inwards-facing flange 29, in order to facilitate the affixing of the flanges to one another by e.g. a welding procedure.

By this means there is obtained the ability to affix the two flanges and thus two adjacent roof panels to one another. The edge 23 with the inwards-facing flange 29 is moreover provided at its lower edge region with an outwards-facing flange 28, whose lower limitation surface is located below the lower limitation surface 10 of the roof panel. The outwards-facing flange 28 serves both as a support device during the abutment of the roof panel against a substrate, and an affixing device for the attachment of the roof panel to the substrate. The roof panel is disposed along all its edges with longitudinal sealing strips 38,39, namely, sealing strips 38',38" are placed in the vicinity of the upper region of each edge, and sealing strips 39',39 in the vicinity of the lower region of each edge. There is thus preferably selected a location in the recess 25 for the edge strip 39' which is disposed in the vicinity of the edge 20. When the roof panels are mounted in place, the sealings strips thus seal the gaps between the adjoining roof panels.

Figure 3:
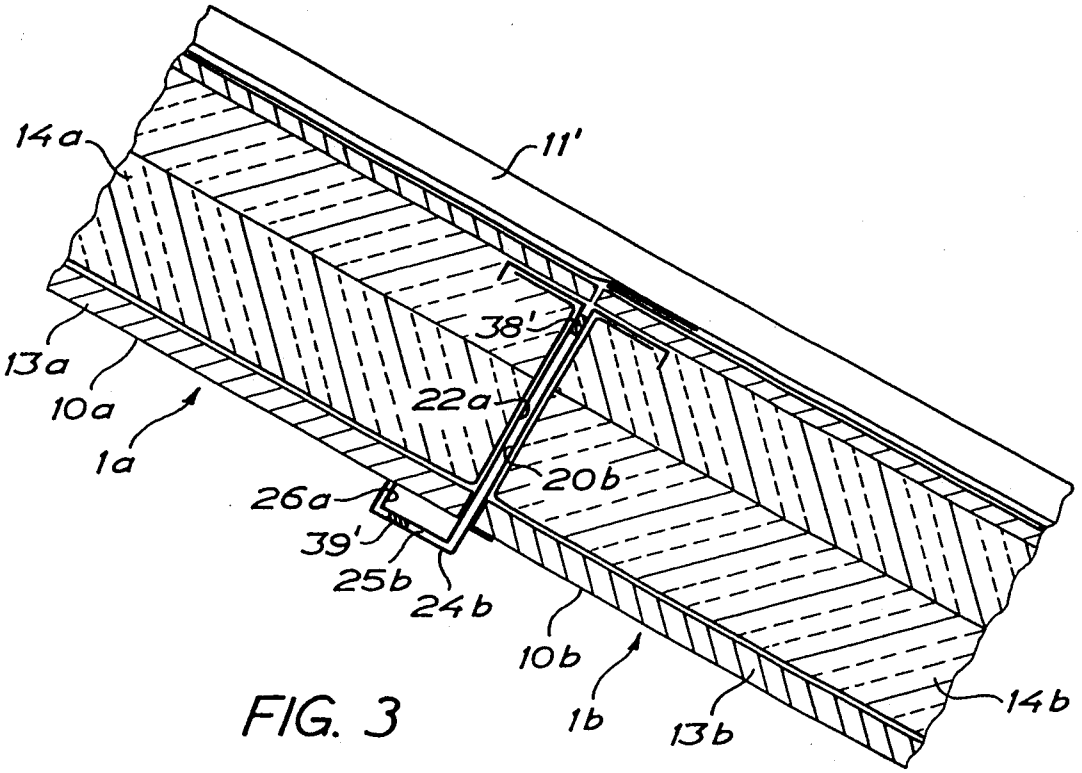
FIG. 3 illustrates a cross-section through the edge regions of two roof panels placed edge to edge.
Figure 4:
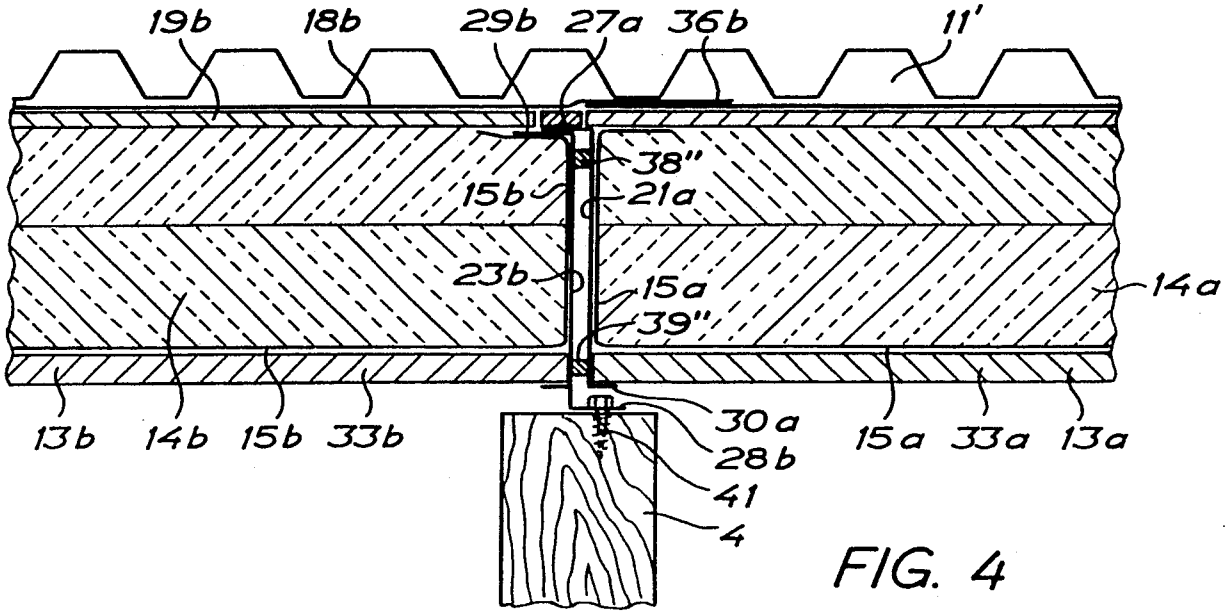
FIG. 4 illustrates a longitudinal section through the edge regions of two roof panels placed edge to edge.

FIG. 4 illustrates how the roof panel is fixed in place, namely, a screw 41 is inserted through a hole in the flange 28 and tightened in position in a substrate 4, which e.g. comprises a roof beam, a support wall etc. In certain applications the flange is welded or glued to the substrate. FIGS. 3 and 4 shows how sealing strips 38',38,39',39 are compressed between two adjacent edges of installed panels.

The roof panel further includes a support course 12,19 for a water-impervious layer 11' or 11 or for a windproof layer 18. In addition the roof panel includes a lower diffusionproof layer 15 and at least one insulating course 14, located in the region between the lower diffusionproof layer and the support course. In the embodiment shown in the figures the lower diffusionproof layer 15 in the vicinity of the edges 20–23 is drawn up towards the upper surface of the roof panel and preferably reaches up to said surface. The figures further show an embodiment where the roof panel is provided with a lower limitation course 13 which simultaneously comprises the inner cladding of the finished roof. In its edge regions the roof panel includes holding devices such as the depicted inwardly extending flanges 37, in order to affix the panels which are located nearest to the edges of the board. In certain applications, the lower limitation course 13 is not included in the roof panel supplied to the building site, but is installed at the site by inserting plate-shaped panel 33 between two transverse auxiliary beams 32, which are disposed between two opposite edges of the frame as shown in FIG. 1*b*.

Figure 2:
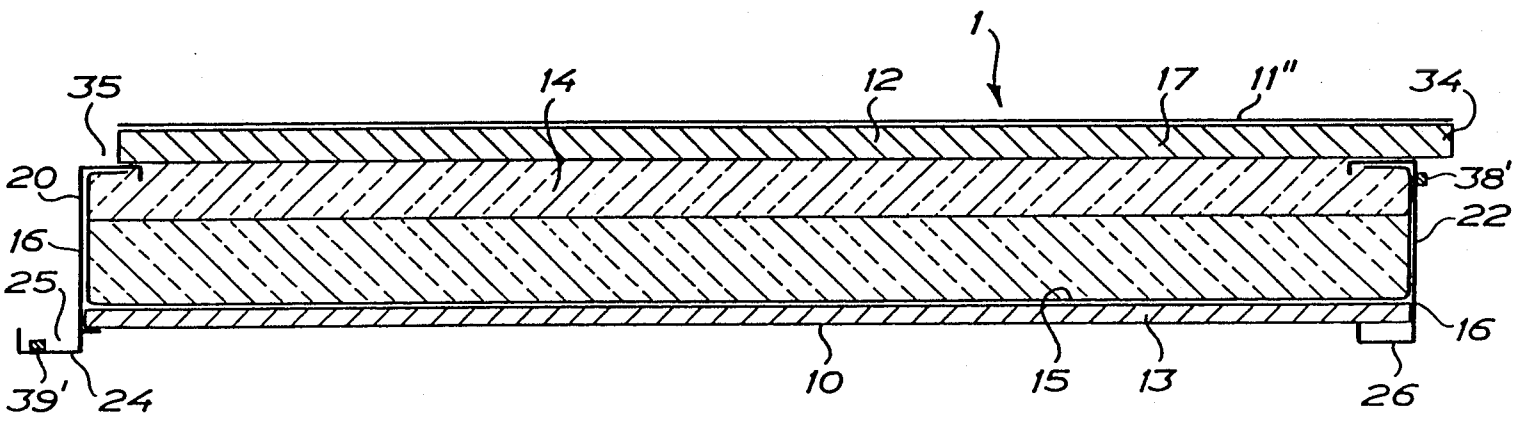
FIG. 2 illustrates a cross-section through an alternative embodiment of the invention.

FIG. 2 shows an embodiment of the invention where there is disposed in the region between the upper water-impervious layer 11" and the upper surface of the frame 16 an insulating course 17. This comprises simultaneously a support course for the water-impervious layer. By means of the insulating course 17, thermal bridges which would otherwise be formed by the frame 16 are substantially eliminated. The figure further shows that the water-impervious layer 11" as well as the insulating course 17 along edge 22 form a protruding portion 34, while the insulating course and the water-impervious layer at the other edge 20 are recessed in order to form regions 35 in which the roof panel is freed from said courses or layers. As a rule two adjacently located edges of one and the same roof panel are disposed with such protruding portions and provided with recessed regions, respectively. When roof panels are placed edge to edge, the joint between two adjacent roof panels will thus be covered by the protruding portions 34. In order to achieve a perfect seal, it is naturally necessary to sealingly attach a strip of water-impervious material over the joint between the layers of water-impervious material in the adjacent roof panels. In certain applications the water-impervious layer is extended beyond the protruding portion 34 in order to form the equivalent of the aforementioned strip.

Figure 1B:
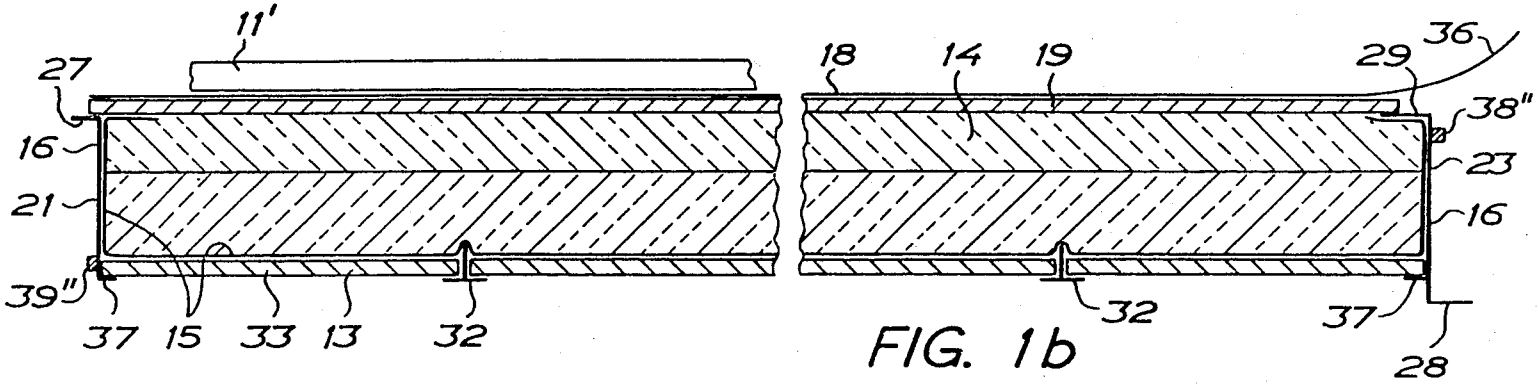

In the embodiment of the invention shown in FIG. 1*b*, the equivalent of the sealing effect described in the preceding paragraph is achieved in that the layer 11' of water-impervious material is comprised as a separate roof coating, which is attached to the roof once the roof panel has been installed. In order to eliminate drafts in the gaps between the roof panels the windproof layer 18 forms in certain embodiments protruding portions 36, which are preferably disposed at two adjacent edges of one and the same roof panel.

FIGS. 3 and 4 show in detail how two roof panels of the embodiment which has been shown in FIGS. 1*a,b* are placed edge to edge. The outwards-facing section 24 thereby encloses with its recess 25 the downwards-facing device 26 of the adjacent roof panel, thereby locking the roof panels in relation to one another. It will be seen from FIG. 4 that each roof panel is affixed to the substrate 4 along edge 23, by attaching the outwards-facing flange 28 to the substrate. FIG. 4 shows the flange 28 bolted in position, although other methods of affixing may obviously be applied, e.g. welding, glueing etc. In its upper edge region the inwards-facing flange 29 is united with the outwards-facing flange 27 of the adjacently located roof panel. Such attachment takes place preferably by means of welding. By this means both the roof panels are thus affixed to the substrate.

It will be evident especially from FIG. 4 that once the left-hand roof panel shown in the Figure has been bolted in position in the substrate, the right-hand roof panel is put in place, whereby its outwards-facing flange 27 will rest against the inwards-facing flange 29 of the first installed roof panel. By folding up the windproof layer 18 both the outwards-facing flange 27 and the inwards-facing flange 29 will be exposed, after which these flanges are affixed to one another, e.g. by means of welding, bolting etc. The protruding portions 36 of the windproof course 18 are then laid down and the upper water-impervious layer 11, which in this embodiment is comprised by a separate outer cladding, is laid in place and affixed to the roof.

It will be evident from the description that the roof panels allow an adaptation of the mechanical stability of the installed roof such that a very stable and rigid structure is provided as required. By this means it is possible to allow the roof to absorb and distribute forces (e.g. dependent on wind load) down to the foundations of the building. This lowers the cost of the building by eliminating the need for stabilizing crosslaid struts.

The foregoing detailed description has made with reference solely to two embodiments of the invention, but it will be easily understood to a person skilled in the art that the invention accommodates a large number of embodiments with the framework of the claims hereinafter.

What is claimed is:

1. A roof construction comprising a roof panel including a plurality of layers superimposed on one another, said panel having four lateral edges arranged in two opposed pairs constituting longitudinal and transverse pairs, and a frame for the panel including four respective frame elements at said lateral edges enabling assembly of adjoining roof panels to one another, said frame elements being relatively rigid, said panel having upper and lower outer surfaces, a first of said frame elements at a first of said edges including a flange projecting outwardly of the panel along said first edge at said upper surface of the panel, a second of said frame elements at a second of said edges opposite said first edge including a flange projecting inwardly of the panel along said second edge at said upper surface and disposed at a level below the outwardly projecting flange of the first frame element such that with the first and second frame elements at the first and second edges of panels adjacent to one another, the outwardly projecting flange of said first frame element rests on the inwardly projecting flange of said second frame element, said second frame element including a flange projecting outwardly of the panel along said second edge at a level below said lower surface of the panel and means for attaching said outwardly projecting flange of the second frame element to a respective roof support, said lower surface of said panel being disposed above said outwardly projecting flange of said second frame element in spaced relation therewith whereby to accommodate the attaching means, a third of said frame elements at a third of said edges of the panel including a section projecting outwardly of the panel along said third edge, said outwardly projecting section defining an upwardly facing recess, a fourth of said frame elements edges of the panel including a section projecting inwardly of the panel along said fourth edge, said inwardly projecting section being shaped and dimensioned to fit into said recess in said section of the third element of an adjacent roof panel to interlock said panels such that each panel is engaged at its longitudinal and transverse edges by adjoining panels and is secured to the roof support by said attaching means thereby enabling the roof construction to be assembled from successive panels from above by resting the outwardly projecting flange of the first frame element on each panel on the inwardly projecting flange of the previously secured adjacent longitudinal panel while transversely positioning the panel by engaging the inwardly projecting section of the fourth frame element into the recess in said outwardly projecting section of the third element of the previously secured adjacent transverse panel whereafter the outwardly projecting flange of said first element can be secured by said attaching means to said respective support.

2. A roof construction as claimed in claim 1 wherein one of said layers of said roof panel comprises a lower diffusion-proof layer which extends along one of said edges up towards the upper surface of the panel.

3. A roof construction as claimed in claim 1 comprising transverse auxiliary beams extending along said panel between opposite edges thereof, the lowermost layer of said panel including sections resting on said auxiliary beams.

4. A roof construction as claimed in claim 1 wherein the uppermost of the layers of the panel is a waterproof layer, an insulating layer being interposed between said waterproof layer and the projecting flanges of the frame elements at the upper surface of the panel to reduce thermal bridges in the panel.

5. A roof construction as claimed in claim 4 wherein said insulating layer supports said waterproof layer.

6. A roof construction as claimed in claim 1 wherein the uppermost of the layers of the panel projects beyond one of the lateral edges of the panel and is recessed at the opposite lateral edge of the panel such that with two adjacent panels assembled to one another, the projecting portion of the uppermost layer of one panel is received in the recessed portion of the other panel.

7. A roof construction as claimed in claim 1 wherein said outwardly projecting section of said third frame element is of U-shape.

8. A roof construction as claimed in claim 1 wherein said first, second and third frame elements each include inwardly projecting flanges supporting the panel at said lower surface thereof.

9. A roof construction as claimed in claim 1 comprising means securing the outwardly projecting flange of the first frame element on each panel to the inwardly projecting flange of the previously secured adjacent longitudinal panel on which it rests.

10. A roof construction as claimed in claim 1 wherein said sections projecting outwardly from the third and fourth edges of the panel are at a level below said lower surface of the panel.

11. A roof construction as claimed in claim 1 wherein said outwardly projecting flange of said second frame element is disposed a sufficient distance below said lower surface of the panel in relation to said attaching means such that each successive panel when engaged at its longitudinal and transverse edges by the adjoining panel projects above and covers the attaching means which secures the previously installed panel to its respective said support.

12. A method of constructing a roof from a plurality of roof panels by assembling the roof panels from above on a roof support, each roof panel having a plurality of layers superimposed on one another and being provided with four lateral edges arranged in two opposed pairs constituting longitudinal and transverse pairs and a frame for the panel including four respective frame elements at said lateral edges enabling assembly of adjoining roof panels to one another, said frame elements being relatively rigid, said panel having upper and lower outer surfaces, a first of said frame elements at a first of said edges including a flange projecting outwardly of the panel along said first edge at said upper surface of the panel and a flange projecting inwardly of the panel along said first edge at said lower surface of the panel, a second of said frame elements at a second of said edges opposite said first edge including a flange projecting inwardly of the panel along said second edge at said upper surface and disposed at a level below the outwardly projecting flange of the first frame element such that the first and second frame elements at the first and second edges of panels can be assembled to one another with the outwardly projecting flange of said first frame element resting on the inwardly projecting flange of said second frame element, said second frame element further including a flange projecting outwardly of the panel along said second edge at a level below said lower surface of the panel, said outwardly projecting flange of the second frame element being attached to a respective roof support by an attaching element, said inwardly projecting flange of said first frame element being disposed above said outwardly projecting flange of said second frame element in spaced relation therewith whereby to accommodate the attaching element, a third of said frame elements at a third of said edges of the panel including a section projecting outwardly of the panel along said third edge, said outwardly projecting section defining an upwardly facing recess, a fourth of said frame elements at a fourth of said edges of the panel including a section projecting inwardly of the panel along said fourth edge, said inwardly projecting section being shaped and dimensioned to fit into said recess in said section of the third element of an adjacent roof panel to interlock said panels such that each panel can be engaged at its longitudinal and transverse edges by adjoining panels and be secured to the respective roof support by said attaching elements thereby enabling the roof construction to be assembled from successive panels from above, said method comprising:

assembling the roof construction from successive panels from above by, resting and securing the outwardly projecting flange of the first frame element of each panel on the inwardly projecting flange of the previously secured adjacent longitudinal panel while transversely positioning the panel by engaging the inwardly projecting section of the fourth frame element into the recess in said outwardly projecting section of the third element of the previously secured adjacent transverse panel, and thereafter securing the outwardly projecting flange of said second element by said attaching element to said respective support.

13. A method as claimed in claim 12 wherein each successive panel when engaged at its longitudinal and transverse edges by the adjoining panels projects above and covers the attaching means which secures the previously installed panel to its respective said support.

* * * * *